US011080973B2

(12) United States Patent
Patterson

(10) Patent No.: US 11,080,973 B2
(45) Date of Patent: Aug. 3, 2021

(54) BURGLARY ALARM ASSEMBLY

(71) Applicant: Shawn Patterson, Katy, TX (US)

(72) Inventor: Shawn Patterson, Katy, TX (US)

( * ) Notice: Subject to any disclaimer, the term of this patent is extended or adjusted under 35 U.S.C. 154(b) by 0 days.

(21) Appl. No.: 16/660,932

(22) Filed: Oct. 23, 2019

(65) Prior Publication Data

US 2021/0125471 A1 Apr. 29, 2021

(51) Int. Cl.
*G08B 13/04* (2006.01)
*G08B 25/10* (2006.01)

(52) U.S. Cl.
CPC ..... *G08B 13/04* (2013.01); *G08B 25/10* (2013.01)

(58) Field of Classification Search
CPC ..... G08B 13/04; G08B 25/10
USPC ..... 340/539.1
See application file for complete search history.

(56) References Cited

U.S. PATENT DOCUMENTS 1,099,480 A 6/1914 Winter
1,965,946 A * 7/1934 Pincus ..... G08B 13/126 340/546
3,825,917 A * 7/1974 Lucky ..... G08B 13/04 340/550
3,863,250 A 1/1975 McClusky, Jr.
4,972,176 A 11/1990 Valiance
5,117,220 A 5/1992 Marino
6,989,746 B2 1/2006 Rasmussen
7,323,979 B2 1/2008 Eskildsen
2004/0135683 A1 7/2004 Sakai
2012/0081226 A1* 4/2012 Hu ..... G08B 13/04 340/541
2018/0198801 A1* 7/2018 Gopalakrishna ..... H04L 63/145
2019/0095804 A1* 3/2019 Mukherjea ..... G06N 5/043

* cited by examiner

*Primary Examiner* — Omar Casillashernandez

(57) ABSTRACT

A burglary alarm assembly for alerting emergency responders to a forced entry includes a window that is positionable in a window opening in a building. A sensing sheet is integrated into the window and the sensing sheet is comprised of a translucent material to pass light therethrough. The sensing sheet is comprised of a brittle material thereby facilitating the sensing sheet to be broken when the window is damaged. An alarm unit is in electrical communication with the sensing sheet. The alarm unit receives an alarm input when the sensing sheet is broken to detect when the window has been damaged by a potential intruder. Moreover, the alarm unit communicates a distress call to emergency responders to alert the emergency responders to the potential of a forced entry at the building.

7 Claims, 6 Drawing Sheets

BURGLARY ALARM ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to alarm devices and more particularly pertains to a new alarm device for alerting emergency responders to a potential forced entry at a building.

(2) Description of Related Art Including Information Disclosed Under 37 CFR 1.97 and 1.98

The prior art relates to alarm devices.

BRIEF SUMMARY OF THE INVENTION

An embodiment of the disclosure meets the needs presented above by generally comprising a window that is positionable in a window opening in a building. A sensing sheet is integrated into the window and the sensing sheet is comprised of a translucent material to pass light therethrough. The sensing sheet is comprised of a brittle material thereby facilitating the sensing sheet to be broken when the window is damaged. An alarm unit is in electrical communication with the sensing sheet. The alarm unit receives an alarm input when the sensing sheet is broken to detect when the window has been damaged by a potential intruder. Moreover, the alarm unit communicates a distress call to emergency responders to alert the emergency responders to the potential of a forced entry at the building.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
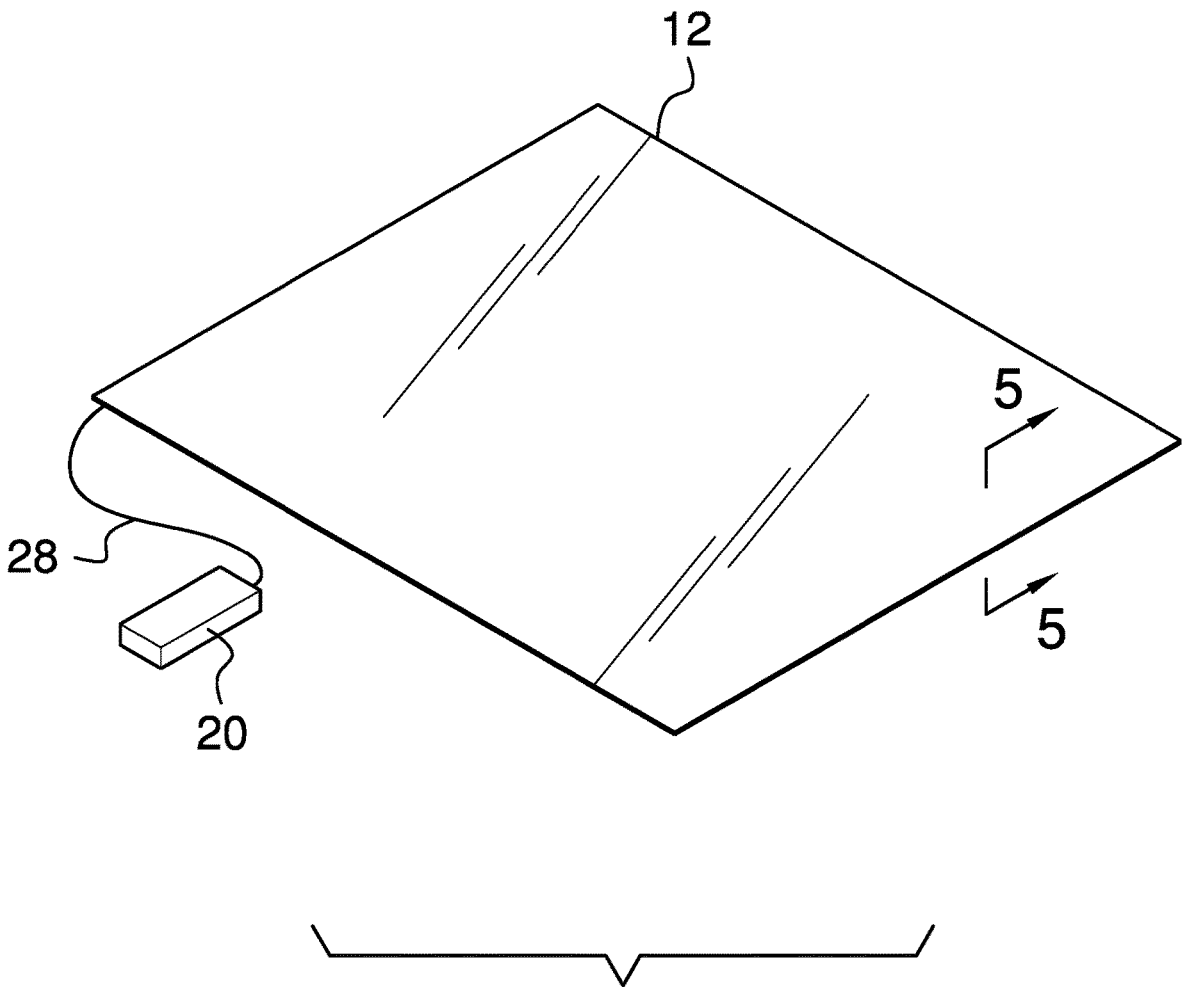
FIG. 1 is a perspective view of a burglary alarm assembly according to an embodiment of the disclosure.
Figure 2:
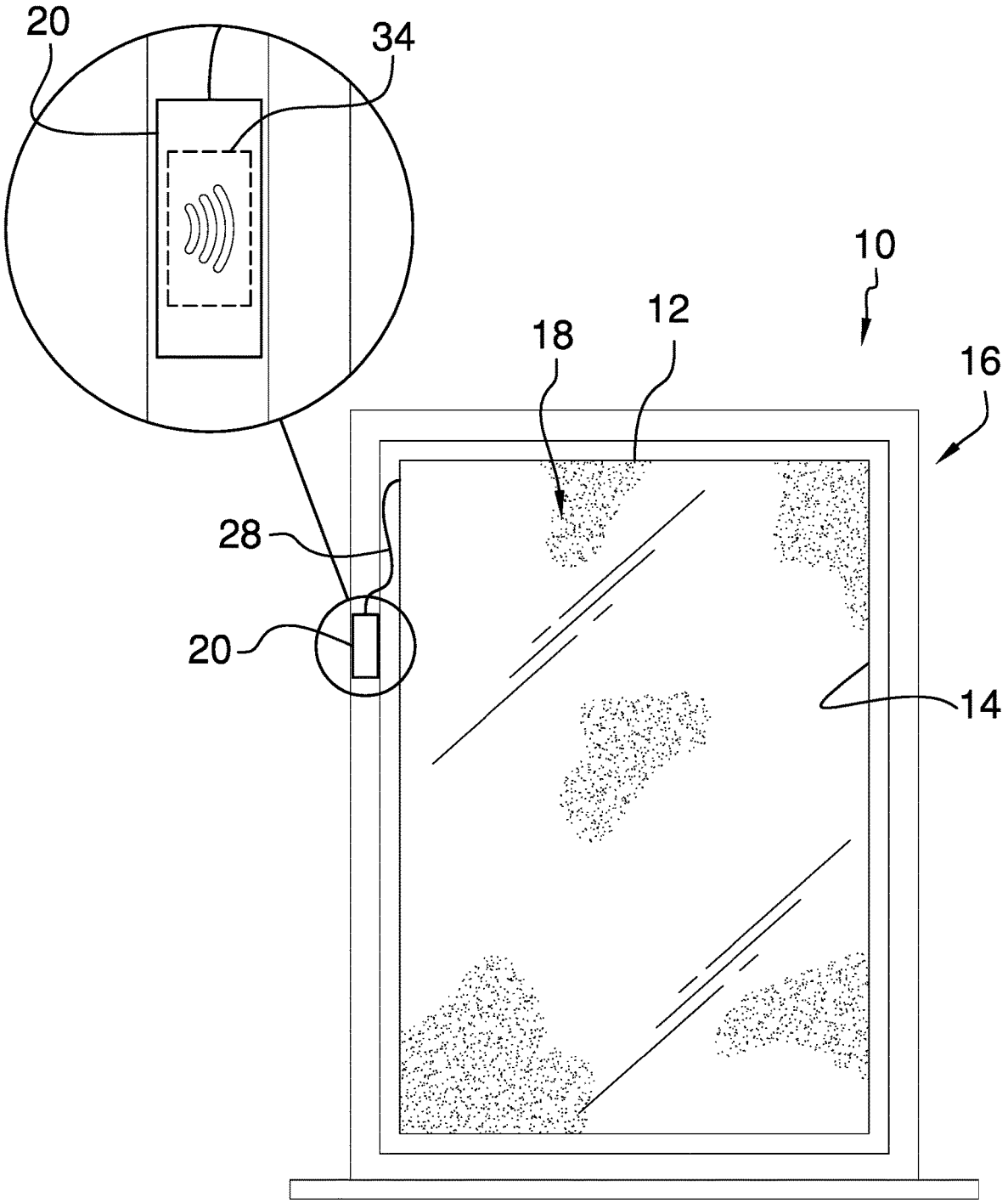
FIG. 2 is a perspective in-use view of an embodiment of the disclosure.
Figure 3:
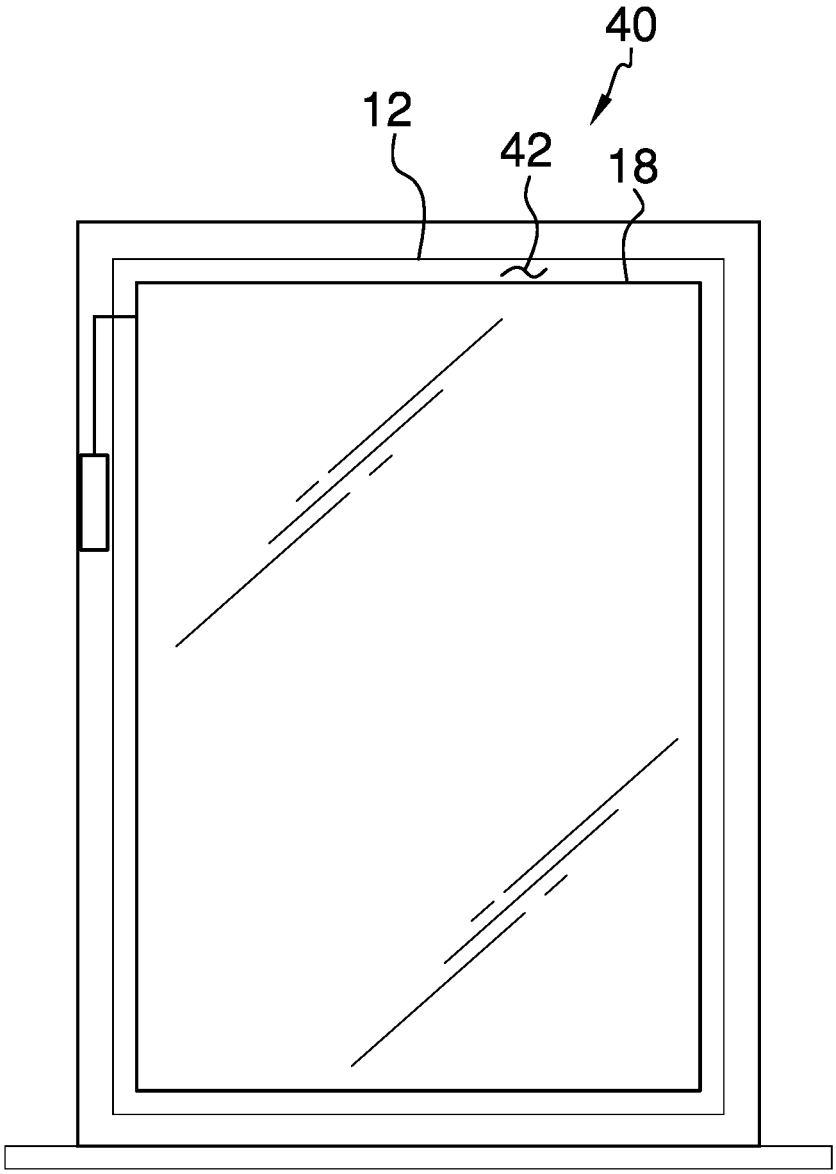
FIG. 3 is a phantom perspective view of an alternative embodiment of the disclosure.
Figure 4:
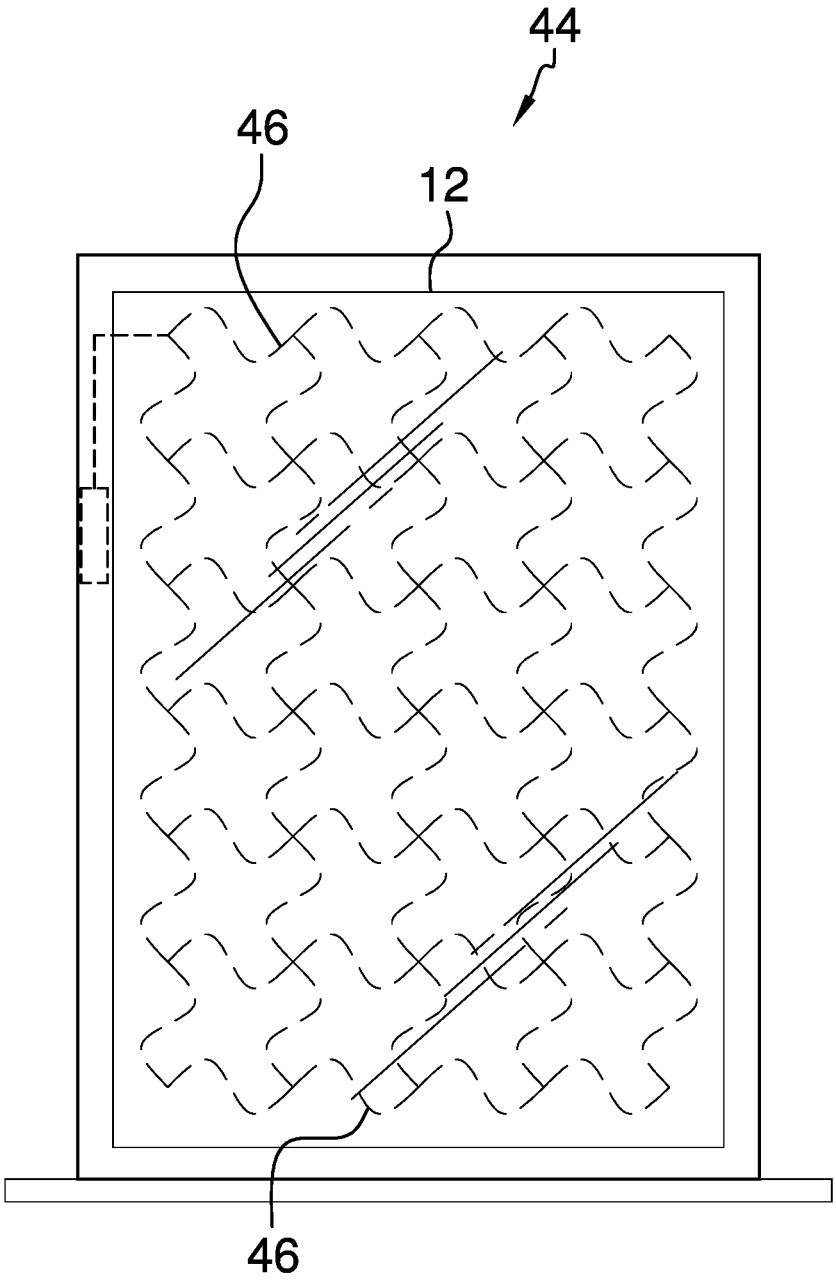
FIG. 4 is a perspective view of an alternative embodiment of the disclosure.
Figure 5:
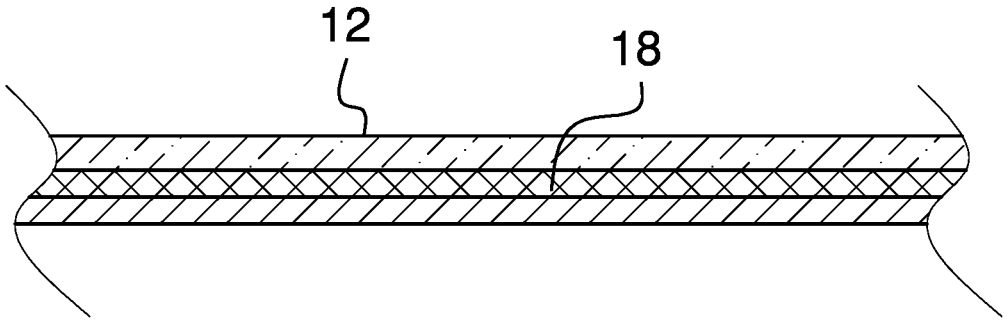
FIG. 5 is a cross sectional view taken along line 5-5 of figured 1 of an embodiment of the disclosure.
Figure 6:
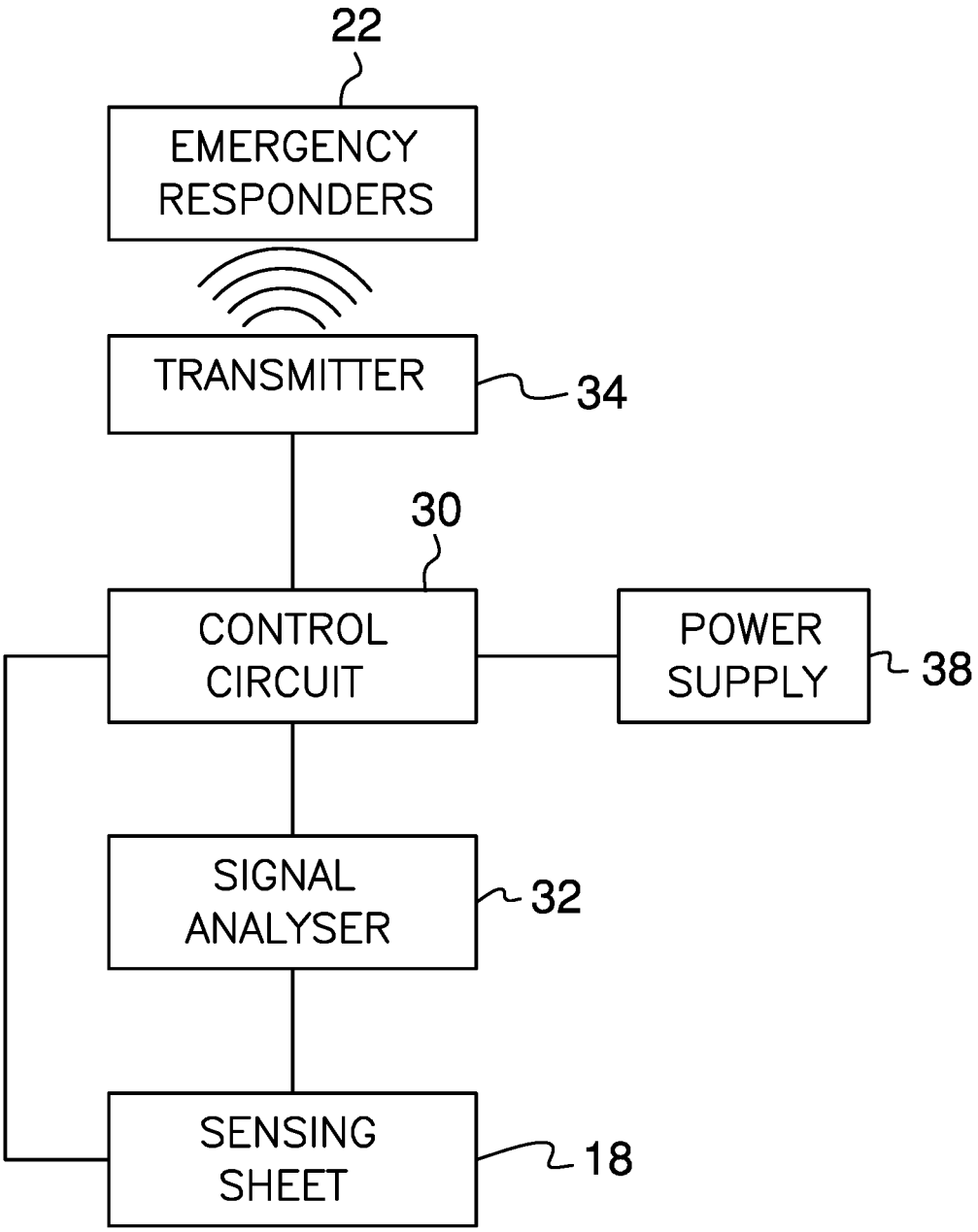
FIG. 6 is a schematic view of an embodiment of the disclosure.

With reference now to the drawings, and in particular to FIGS. 1 through 6 thereof, a new alarm device embodying the principles and concepts of an embodiment of the disclosure and generally designated by the reference numeral 10 will be described.

As best illustrated in FIGS. 1 through 6, the burglary alarm assembly 10 generally comprises a window 12 that is comprised of a transparent material to pass light therethrough. The window 12 is positionable in a window opening 14 in a building 16.

Additionally, the window 12 is comprised of a rigid material to restrict passage through the window opening 14. The window 12 may be comprised of materials that are used in the construction of existing windows.

A sensing sheet 18 is provided and the sensing sheet 18 is integrated into the window 12. The sensing sheet 18 is comprised of a translucent material to pass light therethrough. In this way the sensing sheet 18 does not inhibit an occupant of the building 16 from seeing through the window 12. The sensing sheet 18 is comprised of a brittle material thereby facilitating the sensing sheet 18 to be broken when the window 12 is damaged. Additionally, the sensing sheet 18 is comprised of an electrically conductive material. The sensing sheet 18 may comprise a conductive film that has a pre-determined capacitance.

An alarm unit 20 is provided and the alarm unit 20 is in electrical communication with the sensing sheet 18. The alarm unit 20 receives an alarm input when the sensing sheet 18 is broken. In this way the alarm unit 20 detects when the window 12 has been damaged by a potential intruder. The alarm unit 20 is in remote communication with emergency responders 22 and the alarm unit 20 communicates a distress call to the emergency responders 22 when the alarm unit 20 receives the alarm input. In this way the alarm unit 20 alerts the emergency responders 22 to the potential of a forced entry at the building 16.

The alarm unit 20 comprises a housing 24 that is coupled to an interior wall 26 of the building 16 having the housing 24 being positioned adjacent to the window opening 14. A conductor 28 is electrically coupled to the sensing sheet 18 and the conductor 28 extends between the window 12 and the housing 24. A control circuit 30 is positioned within the housing 24. The conductor 28 is electrically coupled to the conductor 28 such that the control circuit 30 is in electrical communication with the sensing sheet 18. The control circuit 30 continually broadcasts a test signal to the sensing sheet 18 and the control circuit 30 receives an alarm input.

A signal analyzer 32 is positioned within the housing 24 and the signal analyzer 32 is electrically coupled to the control circuit 30. The signal analyzer 32 receives the test signal from the sensing sheet 18. Moreover, the signal analyzer 32 may analyze the capacitance of the sensing sheet 18 based on parameters of the test signal received from the sensing sheet 18. The control circuit 30 receives the alarm input when the signal analyzer 32 determines that the test signal received from the sensing sheet 18 indicates that the sensing sheet 18 has been broken.

A transmitter 34 is positioned within the housing 24 and the transmitter 34 is electrically coupled to the control circuit 30. The transmitter 34 is in wireless communication with an extrinsic communication network 36 and the transmitter 34 is turned on when the control circuit 30 receives the alarm input. Moreover, the transmitter 34 broadcasts a distress signal to the extrinsic communication network 36 when the transmitter 34 is turned on. In this way the transmitter 34 alerts emergency responders 22, such as local police, to the potential of a forced entry at the building 16. The transmitter 34 may be a radio frequency transmitter or the like and the transmitter 34 may employ Bluetooth communication protocols. The extrinsic communication network 36 may be a wireless internet router, a cellular phone network or other form of electronic communication.

A power supply 38 is positioned in the housing 24, the power supply 38 is electrically coupled to the control circuit 30 and the power supply 38 comprises at least one battery. In an alternative embodiment 40 as is most clearly shown in FIG. 3, the sensing sheet 18 is bonded to an interior facing surface 42 of the window 12 with respect to the building 16. In this way the sensing sheet 18 can be attached to a pre-existing window in the building 16. In an alternative embodiment 44 as is most clearly shown in FIG. 4, the alarm unit 20 includes an array of conductors 46 that is integrated into the window 12. The array of conductors 46 is comprised of an electrically conductive material and the array of conductors 46 has a pre-determined resistance to electrical current. The control circuit 30 receives the alarm input when the signal analyzer 32 determines that the pre-determined resistance of the array of conductors 46 has changed as a result of the array of conductors 46 being damaged. Additionally, the array of conductors 46 may be comprised of a translucent material.

In use, the transmitter 34 is placed in wireless communication with the extrinsic communication network 36 when the window 12 is installed into the window opening 14. The signal analyzer 32 continuously analyzes the test signal from the sensing sheet 18. The test signal from the sensing sheet 18 is altered when the sensing sheet 18 is broken as a result of impact damage to the window 12. Thus, the control circuit 30 receives the alert input and the transmitter 34 communicates the distress call to the emergency responders 22. In this way the emergency responders 22 are alerted to the potential of a forced entry at the building 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A burglary alarm assembly being configured to detect when a window in a building has been damaged and subsequently alerting authorities, said assembly comprising:

a window being comprised of a transparent material wherein said window is configured to pass light therethrough, said window being positionable in a window opening in a building, said window being comprised of a rigid material wherein said window is configured to restrict passage through the window opening;

a sensing sheet being integrated into said window, said sensing sheet being comprised of a translucent material wherein said sensing sheet is configured to pass light therethrough, said sensing sheet being comprised of a brittle material thereby facilitating said sensing sheet to be broken when said window is damaged, said sensing sheet being comprised of an electrically conductive material;

an alarm unit being in electrical communication with said sensing sheet, said alarm unit receiving an alarm input when said sensing sheet is broken wherein said alarm unit is configured to detect when said window has been damaged by a potential intruder, said alarm unit being in remote communication with emergency responders, said alarm unit communicating a distress call to the emergency responders when said alarm unit receives said alarm input wherein said alarm unit is configured to alert the emergency responders to the potential of a forced entry at the building;

a housing being coupled to an interior wall of the building having said housing being positioned adjacent to the window opening;

a conductor being electrically coupled to said sensing sheet, said conductor extending between said window and said housing; and wherein said alarm unit includes a control circuit being positioned within said housing, said conductor being electrically coupled to said conductor such that said control circuit is in electrical communication with said sensing sheet, said control circuit broadcasting a test signal to said sensing sheet, said control circuit receiving an alarm input.

2. The assembly according to claim 1, wherein said alarm unit includes a signal analyzer being positioned within said housing, said signal analyzer being electrically coupled to said control circuit, said signal analyzer receiving said test signal from said sensing sheet, said control circuit receiving said alarm input when said signal analyzer determines that said test signal received from said sensing sheet indicates that said sensing sheet has been broken.

3. The assembly according to claim 2, wherein said alarm unit includes a transmitter being positioned within said housing, said transmitter being electrically coupled to said control circuit, said transmitter being in wireless communication with an extrinsic communication network, said transmitter being turned on when said control circuit receives said alarm input, said transmitter broadcasting a distress signal to the extrinsic communication network when said transmitter is turned on wherein said transmitter is configured to alert emergency responders to the potential of a forced entry at the building.

4. The assembly according to claim 2, wherein said alarm unit includes a power supply being positioned in said housing, said power supply being electrically coupled to said control circuit, said power supply comprising at least one battery.

5. A burglary alarm assembly being configured to detect when a window in a building has been damaged and subsequently alerting authorities, said assembly comprising:

a window being comprised of a transparent material wherein said window is configured to pass light therethrough, said window being positionable in a window opening in a building, said window being comprised of a rigid material wherein said window is configured to restrict passage through the window opening;

a sensing sheet being integrated into said window, said sensing sheet being comprised of a translucent material wherein said sensing sheet is configured to pass light therethrough, said sensing sheet being comprised of a brittle material thereby facilitating said sensing sheet to be broken when said window is damaged, said sensing sheet being comprised of an electrically conductive material; and an alarm unit being in electrical communication with said sensing sheet, said alarm unit receiving an alarm input when said sensing sheet is broken wherein said alarm unit is configured to detect when said window has been damaged by a potential intruder, said alarm unit being in remote communication with emergency responders, said alarm unit communicating a distress call to the emergency responders when said alarm unit receives said alarm input wherein said alarm unit is configured to alert the emergency responders to the potential of a forced entry at the building, said alarm unit comprising:

a housing being coupled to an interior wall of the building having said housing being positioned adjacent to the window opening;

a conductor being electrically coupled to said sensing sheet, said conductor extending between said window and said housing;

a control circuit being positioned within said housing, said conductor being electrically coupled to said conductor such that said control circuit is in electrical communication with said sensing sheet, said control circuit broadcasting a test signal to said sensing sheet, said control circuit receiving an alarm input;

a signal analyzer being positioned within said housing, said signal analyzer being electrically coupled to said control circuit, said signal analyzer receiving said test signal from said sensing sheet, said control circuit receiving said alarm input when said signal analyzer determines that said test signal received from said sensing sheet indicates that said sensing sheet has been broken;

a transmitter being positioned within said housing, said transmitter being electrically coupled to said control circuit, said transmitter being in wireless communication with an extrinsic communication network, said transmitter being turned on when said control circuit receives said alarm input, said transmitter broadcasting a distress signal to the extrinsic communication network when said transmitter is turned on wherein said transmitter is configured to alert emergency responders to the potential of a forced entry at the building; and a power supply being positioned in said housing, said power supply being electrically coupled to said control circuit, said power supply comprising at least one battery.

6. The assembly according to claim 5, wherein said sensing sheet is bonded to an interior facing surface of said window with respect to the building.

7. The assembly according to claim 5, further comprising an array of conductors, said array of conductors being integrated into said window, said array of conductors being comprised of an electrically conductive material, said array of conductors having a pre-determined resistance to electrical current, said control circuit receiving said alarm input when said signal analyzer determines that said pre-determined resistance of said array of conductors has changed as a result of said array of conductors being damaged.

* * * * *